United States Patent [19]

Colten

[11] 4,419,569

[45] Dec. 6, 1983

[54] MODULAR HEATING CABLE ASSEMBLY

[75] Inventor: Jerrold L. Colten, Lakeville, Ind.

[73] Assignee: Bristol Corporation, Elkhart, Ind.

[21] Appl. No.: 23,884

[22] Filed: Mar. 26, 1979

[51] Int. Cl.[3] ..... H05B 3/36

[52] U.S. Cl. ..... 219/528; 219/517; 219/535; 219/549; 337/208; 338/214

[58] Field of Search ..... 219/506, 212, 517, 528, 219/535, 548, 549; 338/113 L, 213, 214; 339/113 L, 113 R, 153, 154 A, 154 R; 337/208, 228, 401, 416

[56] References Cited

U.S. PATENT DOCUMENTS

| | | | |
|---|---|---|---|
| 3,341,690 | 9/1967 | Cummins | 219/528 |
| 3,423,574 | 1/1969 | Shomphe | 219/528 |
| 3,851,149 | 11/1974 | Daley | 219/528 |
| 4,025,755 | 5/1977 | Shiree et al. | 219/549 |
| 4,066,870 | 1/1978 | Colten | 219/528 |
| 4,101,190 | 7/1978 | Schoff | 339/113 L |

*Primary Examiner*—Volodymyr Y. Mayewsky
*Attorney, Agent, or Firm*—Marmaduke A. Hobbs

[57] ABSTRACT

A modular heating cable assembly having two cold wires extending the length thereof and a resistance heating wire interconnecting the two wires. The portion of the two wires anterior to the heating wire forms a cold lead, and an element for interrupting the circuit to the heating wire is disposed in one of the wires of the cold lead. The assembly may consist of a cold lead module and one or more heating cable modules, and the element for interrupting the current may be disposed either in the cold lead or in a separate unit disposed between the cold lead module and the heating module.

3 Claims, 5 Drawing Figures

MODULAR HEATING CABLE ASSEMBLY

A widespread practice of preventing roof gutters, valleys and eaves on buildings, particularly on residential buildings, from freezing and becoming clogged with ice and snow, is to lay an electric heating cable in the gutter or valley and to attach a heating cable to the eaves of the roof in a configuration over a longitudinal area of one to two feet wide. In order to keep the gutters and valleys open and to prevent the accumulation of ice on the eaves of the roof, the heating cable must sometimes be forty to sixty feet in length, and even longer if the cable assembly also is used to keep the downspouts free of ice. These long lengths of heating cable have made marketing of the product difficult, in that the various lengths must be kept in stock and, since it is often difficult to anticipate the length of heating cable required for a particular installation, the wrong lenght of cable is purchased and wasted, in that if the cable is too long it cannot be cut to the required length without rendering the cable inoperable, and if the cable is too short it must either be discarded for the correct length or a second cable independently installed and connected directly to the source of electric power. These same problems and difficulties are also encountered in installing heating cables on water and drain pipes to prevent freezing. As an alternative to the foregoing conventional installations, a modular heating assembly has been developed and has had favorable acceptance both by the merchants and by those who install the heating cable. This type of assembly is disclosed in U.S. Pat. No. 3,341,690. With the modular type cable assembly, only a limited number of relatively short sections need be stocked by the merchant, and installation can be made by assembling the number of sections required for any particular installation, and an existing installation can be extended and expanded by merely adding one or more cable sections on to those already in use. The modular type makes a versatile product which can effectively and conveniently be installed on water and drain pipes and in gutters, without first requiring an accurate estimate of the final length of the installed cable assembly.

One problem or disadvantage in modular heating cable systems, however, has been that it is not uncommon to overload the assembly by initially installing or later adding more modules than the electrical supply system or the modular assembly can handle; thus short circuiting of the supply system or burning out of the modular assembly occurs, the latter condition normally causing serious and possibly irreparable damage to the assembly and occasionally creating a serious hazard to the building structure on which the assembly has been installed. It is therefore the principal object of the present invention to provide a modular heating cable assembly having an electrical overload means therein to interrupt the operation of the heating assembly in the event more modules are included in or added to the system than can be handled either by the electrical supply system or by the modular assembly or any part thereof, and in which an electrical overload or limiting means can be included in the modular assembly regardless of the number of modules or arrangement of the modules in the assembly or system.

Another object of the invention is to provide a modular heating system which includes a current interrupting means capable of being incorporated in any one of a number of locations in the modular assembly for effectively protecting the assembly and the electrical supply system in the event there is an overload of the assembly, and which is simple in construction and operation and lends itself to a variety of different types of anti-freeze installations, including water supply and drain pipes, gutters, downspouts, roof valleys, and snow melting installation along the eaves of roofs.

Further objects and advantages of the present invention will become apparent from the following description and accompanying drawings, wherein.

Figure 1:
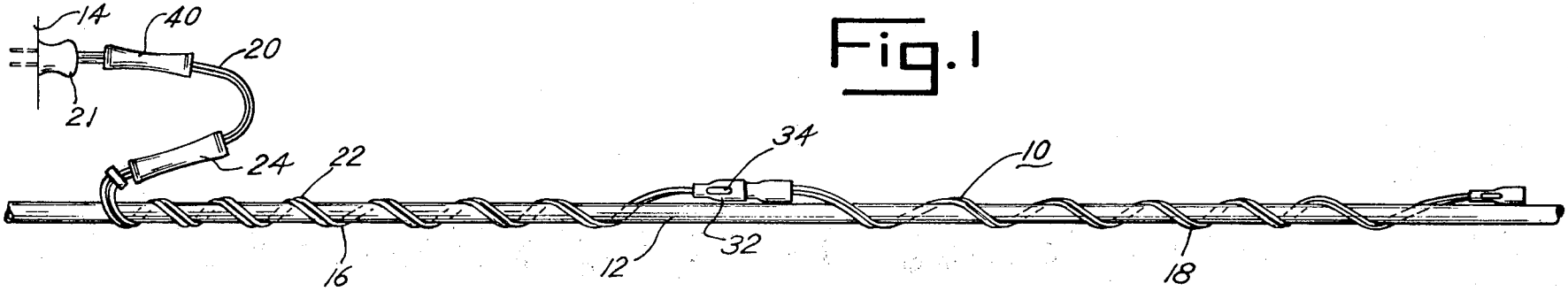
FIG. 1 is an elevational view of a modular heating cable installation illustrating the manner in which a current interrupting device of the present invention is incorporated therein.

Referring more specifically to the drawings, and to FIG. 1 in particular, numeral 10 indicates a modular heating cable assembly installed on a water pipe 12 and connected to an electrical outlet 14. While the modular heating assembly is shown spirally wound around the water pipe, various other configurations may be used to obtain the desired distribution of heat in the installation, and, while only two modules 16 and 18 are shown in FIG. 1, additional modules of the type shown may be employed to extend the length of the heating cable assembly to satisfy requirements.

In the embodiments of the invention illustrated in FIG. 1, the first module 16 consists of a cold lead 20 having a plug 21 for inserting in a conventional outlet socket 14 from which the source of electric power is obtained for operating the heating cable assembly. This module includes a heating section 22 connected to the cold lead, and a thermostat, with leads associated therewith, enclosed in a waterproof plastic envelope 24. The details of the thermostat, which may include a by-pass switch for the purpose of testing the unit, are not considered a part of the invention and hence will not be described in detail herein; however, several well known types are suitable for use in the present cable, such as the one disclosed in U.S. Pat. No. 4,066,870 issued Jan. 3, 1978. The prior patent also illustrates the manner in which the resistance heating wires may be connected in both modules 16 and 18, and the manner in which the cold leads may be used for transmission of the electrical current from one module to another, regardless of whether the heating element of any particular module is operative. Hence, the disclosure concerning the details of the various modules of the prior patent is incorporated herein by reference. Module 16 terminates at electrical socket 32 having thumb and finger gripping areas 34 on opposite sides thereof.

Figures 3, 4, 5:
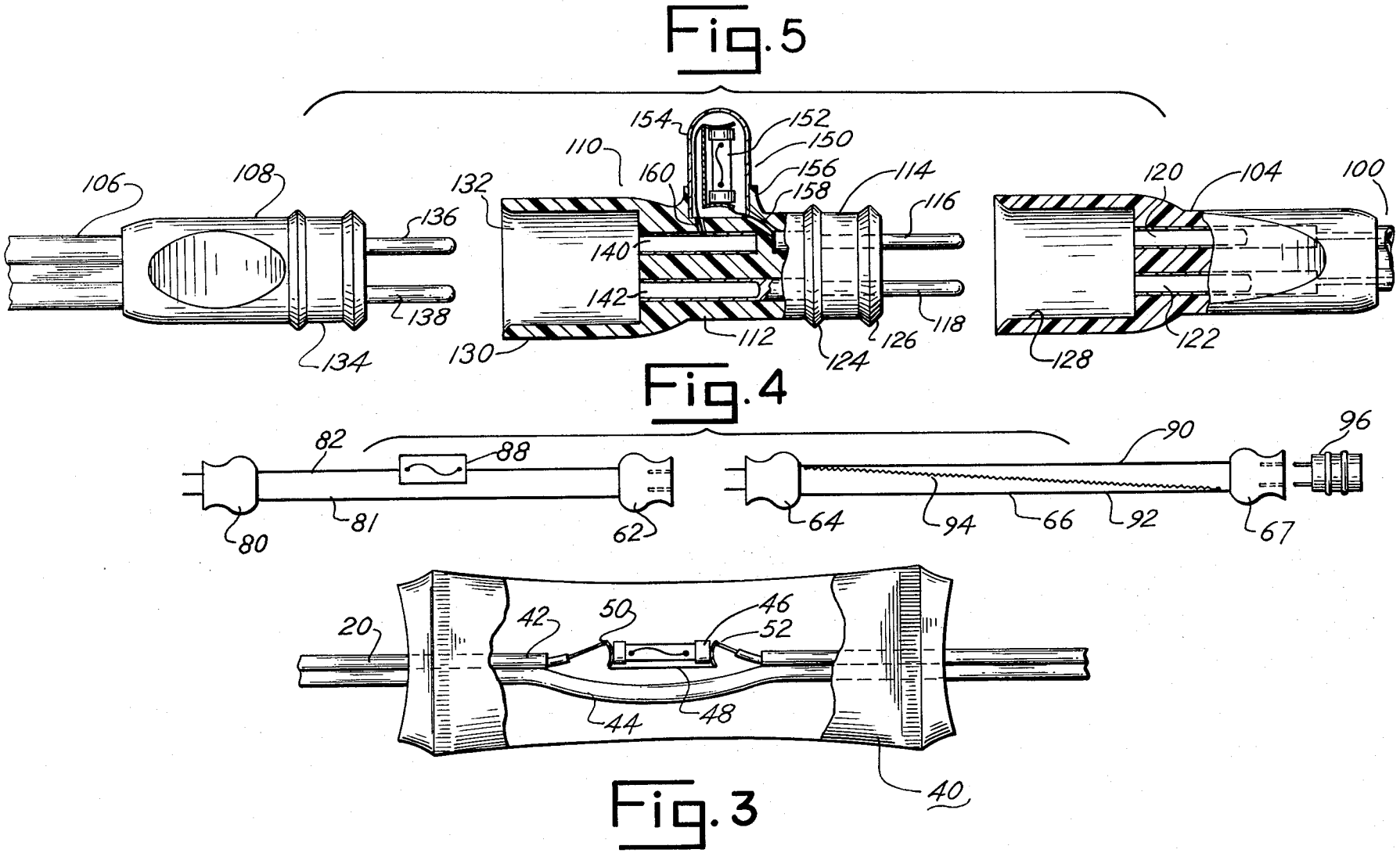
FIG. 3 is an enlarged elevational view of one form of circuit breaker device, with a portion of the housing thereof being broken away to better illustrate the construction.
FIG. 4 is a schematic view of two modules of the cable assembly illustrating the circuitry thereof.
FIG. 5 is an exploded elevational and partial cross sectional view of a modular cable assembly similar to that shown in FIGS. 1 and 2, but illustrating a modification thereof.

In the embodiment of the invention illustrated in FIG. 1, the cold lead 20 of module 16 contains current interrupting device, such as a circuit breaker or fuse, disposed in a plastic waterproof envelope, the fuse or other such device preferably being located between the plug 21 and the thermostat unit 24. The circuit breaker interrupting device is rated to carry the electric current for a predetermined length of cable up to and including a selected number of modules, such as two, three or four modules. A suitable type of circuit breaker is illustrated in FIG. 3 which is an enlarged view with a portion of the envelope of unit 40 broken away to show the internal construction thereof. The ungrounded wire 42 and neutral 44 of wire 20 is separated and a fuse element 46 is inserted in a clip 48 connected to the ends 50 and 52 of wire 42. After the unit has been assembled in the manner shown in the drawing, the envelope is heat-sealed onto and around wire 20 so that the unit is fully waterproof. The fuse is shown as a replaceable type; however, it may be one which requires installation by soldering the wires in the two ends 50 and 52. In the event the fuse of the type shown in FIG. 3 is overloaded, and the fuse is blown, the envelope is opened and the fuse replaced. This can be done by making a single slit in the envelope and, after the fuse element has been replaced, the slit is sealed either by tape or cement or by heat. The fuse or other type of overload, current interrupting device can be enclosed in the same pouch as the thermostat.

Figure 2:
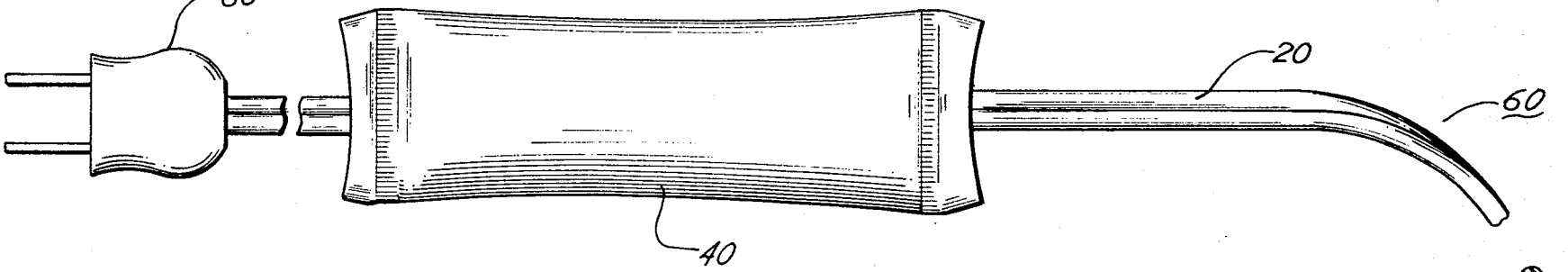
FIG. 2 is an enlarged elevational view of a modular heating cable similar to that shown in FIG. 1.
Figure 2:
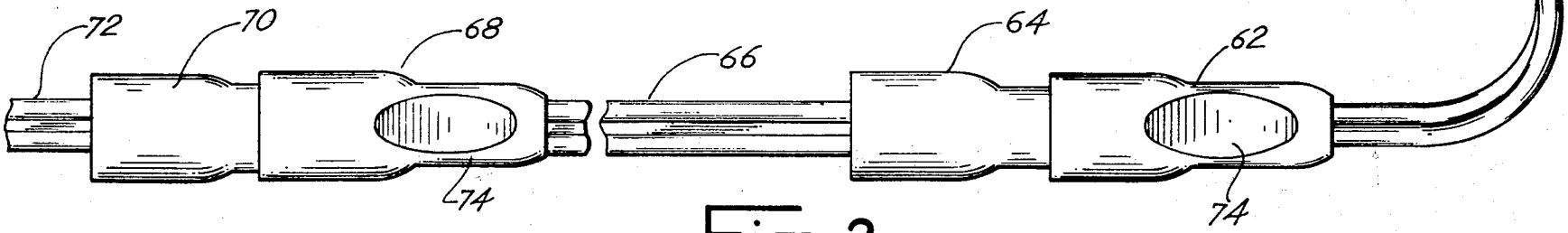

An enlarged fragmentary view of the installation is illustrated in FIG. 2 and, in the particular embodiment shown, the thermostat has been omitted; however, the current interrupting device can be used satisfactorily whether or not the thermostat is included in the unit. In the embodiment of FIG. 2, the circuit breaker is contained in a separate cold lead 60 which has a female connector 62 adapted to receive a male connector 64 of heating cable module 66, the latter having a female connector 68 for receiving a male connector 70 of a second heating module 72, the two latter connectors being identical or similar to connectors 62 and 64, respectively, the female connectors 62 and 68 being provided with thumb and finger gripping areas 74 on the sides thereof. The cold lead is shown as having a standard two pronged plug 80 which is intended to be used in an ordinary household socket; however, preferably the plug and socket are of the polarized type which will assure that the wire in which the fuse is mounted will be connected with the hot wire of the building circuit.

The circuitry of the modular heating cable assembly shown in FIG. 2 is illustrated schematically in FIG. 4. The cold lead consists of two wires 81 and 82 connecting male and female connectors 80 and 62 and containing a fuse unit 88 disposed in wire 82. The heating cable 66 consists of two parallel wires 90 and 92 which carries the current through the cable from male connector 64 to female connector 67, and a resistance wire 94 which generates the heat in the cable is connected at one end to wire 90 near male connector 64 and to wire 92 near female connector 67. A third or fourth heating cable module connected to connecor 67 would normally be of the same construction as module 66; however, the length of one module may be different from that of the other. The last module of the assembly, which normally would have a female connector at its free end, is sealed by a plug, schematically illustrated at numeral 96, which seats in the female connector and prevents water from entering the socket and shorting the circuit.

A modified and more versatile type assembly, shown in FIG. 5, consists of a cold lead module, shown in part at numeral 100, having a female connector 104, and a heating cable module, shown in part at numeral 106, having a male connector 108. The cold lead, which may or may not contain a thermostatic element, is connected to the heating cable through a current interrupting unit 110 consisting of a body 112 having a male portion 114 with blades 116 and 118 for seating in holes 120 and 122, respectively, where it makes electrical contact with terminals of the two wires in the cold lead. The male portion preferably has sealing rings 124 and 126 for seating on the internal side surface 128 of connector 104. Unit 110 contains a female portion 130 having a socket 132 for receiving the male portion 134 of connector 108, blades 136 and 138 seating in holes 140 and 142, respectively, where they engage terminals for completing the circuit from unit 110 to heating cable 106.

The circuit is completed through unit 110 directly from blade 118 to the terminal in hole 142 and from blade 116 to the terminal in hole 140 through circuit breaker 150. The circuit breaker includes a fuse 152 disposed in a capsule 154 seated in a water-tight relationship with the inner surface of a wall of an annular boss 156. One terminal of the fuse is connected to the blade 116 by wire 158 and to the terminal in hole 140 by a wire 160. The particular advantage of the unit 110 is the fact that it can be installed in the assembly at any time and can use a standard separate cold lead connected through unit 110 to the first modular heating cable. In the event fuse 152 should be blown, capsule 154, which is held firmly but releasably in annular boss 156, can be removed therefrom and the fuse replaced and the capsule returned to its water-tight relationship in boss 156.

In the use of the modular system of the present invention, either a separate cold lead or one formed integrally with the first module is mounted on a pipe or other structure to be heated, and one or more heating cable modules are mounted on the structure in a suitable manner, such as that illustrated in FIG. 1. Whether the cold lead is a separate unit or one formed integrally with the first heating module, the fuse element 46 protects not only the first unit but all of the subsequent units, in the event of an overload created by an excessive number of modules or in the event any one of the modular cables is damaged. If the cold lead is of the standard type, with or without a thermostat, but without a fuse or circuit breaker, unit 110 is inserted between the cold lead and the first heating cable module. While the unit 110 could be inserted between any two modules, the unit will protect all of the heating cables if mounted in the manner illustrated in FIG. 5, or modified so that it can be installed at outlet 14. The female connector of the last heating module is rendered safe by a plug 96 inserted therein in a waterproof relationship.

When an installation is being made, the number of modules can be varied to satisfy requirements so long as that circuit is not overloaded to the extent that the circuit breaker or fuse will be blown. Further, after the installation has been made, if additional modules are required, additional modules can be included in the assembly and the entire assembly protected by the circuit breaker or fuse. The fuse not only protects the assembly but also increases the safety of the structure being heated by the assembly.

While several embodiments of the present modular heating cable assembly have been described herein, various changes and modifications may be made without departing from the scope of the invention.

I claim:

1. A modular heating cable assembly comprising two electrical cold wires extending substantially the full length of the assembly and being divided into a cold lead module and a heating module, a connector at one end of said assembly connected to said wires for connecting said wires to a source of electrical current, a female connector at the other end of said assembly connected to said wires, a resistance heating means connected at one end to one of said cold wires and connected at the other end to the other of said cold wires, and a fuse means connected to one of said cold wires in said assembly anterior to said heating wire and being responsive to an excessive amount of current in said one cold wire for interrupting the current in the event of an overload of current in said cold wires, said fuse means being a separate, insertable and removable unit adapted to be disposed between said cold lead module and said heating module and having a waterproof housing with male and female ends for connection in a waterproof relation with female and male ends, respectively, on said modules.

2. A modular heating cable assembly as defined in claim 1 in which a thermostatic control means is disposed in said cold lead module.

3. A modular heating cable assembly as defined in claim 1 in which one of said cold wires is a positive wire and the other of said wires is a neutral wire, and said means for interrupting the circuit consists of a fuse disposed in said positive wire, and in which said assembly includes a cold lead and said waterproof housing seals said fuse in said cold lead.

* * * * *